US007952558B2

(12) United States Patent
Yang et al.

(10) Patent No.: US 7,952,558 B2
(45) Date of Patent: May 31, 2011

(54) METHODS FOR DRIVING ELECTROPHORETIC DISPLAY SO AS TO AVOID PERSISTENT UNIDIRECTIONAL CURRENT THROUGH TFT SWITCHES

(75) Inventors: Young-Chol Yang, Seongnam-si (KR); Ho-Yong Jung, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 914 days.

(21) Appl. No.: 11/863,702

(22) Filed: Sep. 28, 2007

(65) Prior Publication Data

US 2008/0079688 A1 Apr. 3, 2008

(30) Foreign Application Priority Data

Sep. 29, 2006 (KR) ..... 10-2006-0095861

(51) Int. Cl.
*G09G 3/34* (2006.01)

(52) U.S. Cl. ..... 345/107; 345/55

(58) Field of Classification Search ..... 345/50–55, 345/107, 87–102, 204
See application file for complete search history.

(56) References Cited

U.S. PATENT DOCUMENTS

| | | | | |
|---|---|---|---|---|
| 2005/0122284 | A1* | 6/2005 | Gates et al. | 345/60 |
| 2005/0179642 | A1* | 8/2005 | Wilcox et al. | 345/107 |
| 2006/0139308 | A1* | 6/2006 | Jacobson et al. | 345/107 |
| 2007/0200795 | A1* | 8/2007 | Whitesides et al. | 345/55 |
| 2010/0149169 | A1* | 6/2010 | Miyasaka | 345/213 |

* cited by examiner

*Primary Examiner* — Nitin Patel
(74) *Attorney, Agent, or Firm* — Innovation Counsel LLP

(57) ABSTRACT

Certain types of displays such as electrophoretic displays tend to deteriorate if their pixel units are persistently driven by currents flowing in only one direction for the purpose of maintaining (i.e. refreshing) a relatively constant optical state. A first method pulses the pixel unit with a drive pulse of opposed polarity but duration too short (i.e. less than 1/25 second) for a viewer to notice. A second method pulses the pixel unit with a drive pulse of opposed polarity but magnitude to small to effect change in optical state.

24 Claims, 10 Drawing Sheets

METHODS FOR DRIVING ELECTROPHORETIC DISPLAY SO AS TO AVOID PERSISTENT UNIDIRECTIONAL CURRENT THROUGH TFT SWITCHES

CROSS-REFERENCE TO RELATED APPLICATION

This application claims priority to and the benefit of Korean Patent Application No. 10-2006-0095861 filed in the Korean Intellectual Property Office on Sep. 29, 2006, the entire disclosure of which is incorporated herein by reference.

BACKGROUND (a) Field of Invention

The present disclosure of invention relates to methods for driving pixel areas of an electrophoretic display.

(b) Description of Related Art

Recently, for replacing the conventional CRT tubes; flat panel displays, such as liquid crystal displays, organic light emitting diode displays, electrophoretic displays, and so on, have been developed.

Among the above flat panel displays, the typical electrophoretic display includes: (1) a thin film transistors (TFT) array supporting panel including pixel electrodes each connected to a thin film field effect transistor; (2) a common electrode supporting panel having a common electrode included thereon, and (3) a layer of electrophoretic particles that have positive or negative charges which are positioned in respective pixel regions, and move between the pixel electrodes of the respective pixel areas and the common electrode. A combination of a single pixel electrode and its opposed area in the spaced-away common electrode and its TFT and the eletrophoretic particles disposed between the pixel electrode and common electrode may be considered as a pixel unit that can be driven by electromotive forces at least between first and second different optical states (i.e. red and black).

When different data voltages are applied to the pixel electrodes relative to and a common voltage applied to the common electrode, the differences between the data voltages and the common voltage can be sufficient to generate electromotive forces that rearrange the electrophoretic particles that are disposed in the respective pixel regions so as to provide a desired optical state. A first polarity set of the electrophoretic particles having positive or negative charges are attracted to move adjacent to the pixel electrodes while the opposed, second polarity set of particles are attracted to move adjacent to the common electrode by use of a first polarity of driving voltage. Along with the voltage-mediated re-arrangement of the electrophoretic particles, an external light applied to the electrophoretic display may be absorbed by or reflected by the electrophoretic particles, to thereby display the corresponding pixel area as being of a respective black or white or other colored attribute to a user who is looking at the display.

While some parts of a displayed image may be constantly changing between opposed states (e.g., first displaying white and then black), it is often the case that other parts of the displayed image persistently remain in a same state (e.g., displaying just black as a background color for example) for prolonged periods of time (e.g., 3 seconds or more). In these relatively unchanging areas, it is conventional to apply the same positive or negative driving voltage constantly to the electrophoretic particles for the duration of the time that the user is intended to perceive the area as having a constant black or white or other color. However, when a data voltage having the same polarity and magnitude is re-applied periodically to the pixel electrode of the corresponding pixel region through the thin film transistor for a long period of time, the electrical current that flows through the corresponding thin film transistor (TFT) in order to charge the corresponding pixel-electrode to the desired constant voltage flows in only one direction. (The capacitance of the pixel unit discharges internally after a while and needs to be refreshed in order to maintain the desired persistent optical state.) When current flows through some thin film transistors in only one direction, a current-induced deterioration of the thin film transistor (i.e., due to electromigration) is accelerated as compared to the case in which current flows alternately in opposite directions through a TFT of same structure.

SUMMARY

One or more methods for driving pixel units of an electrophoretic display are disclosed here for preventing or reducing deterioration of the electrophoretic display due to persistent unidirectional flow of current through display circuitry such as through the thin film transistors of the display.

A first method in accordance with the disclosure for driving an electrophoretic display comprises briefly driving a pixel unit whose pixel area is to appear as persistently having a same color (or as persistently black) to its opposed state for a time period too short for an average human viewer to notice (e.g., for a duration of less than 1/25 of a second) and then driving the pixel unit back to its desired persistent state so that the viewer perceives the desired persistent color (or persistent black state).

In one embodiment, the magnitude of a first threshold driving voltage (the voltage which flips the charge on pixel area towards its opposed state) may be substantially the same as the magnitude of the second threshold driving voltage (the voltage which charges the pixel area towards its desired, more persistent state).

In another embodiment, the magnitude of the first threshold driving voltage may be smaller than the magnitude of the second threshold driving voltage and in one specific variation, the first threshold driving voltage has such a magnitude that its electromotive force is insufficient to change the relative positions of the positive and negative electrophoretic particles relative to the user's line of view so that the human viewer does not perceive a change of state even though the pixel area is being periodically driven towards an opposed state for purposes of periodically alternating the direction of current flowing through the TFT of that pixel area. In this alternate embodiment where the state flipping first voltage is of insufficient magnitude, the first time may be substantially equal to the second time. In one further variation, the first time is longer than the second time. In one embodiment, the integral over time for the positive and negative drive pulses are substantially the same. For example, in one variation using rectangular pulses, the product of multiplication of the first threshold driving voltage and its corresponding first on time may be substantially equal to the product of multiplication of the second threshold driving voltage and its corresponding second on time.

DETAILED DESCRIPTION

Figure 1:
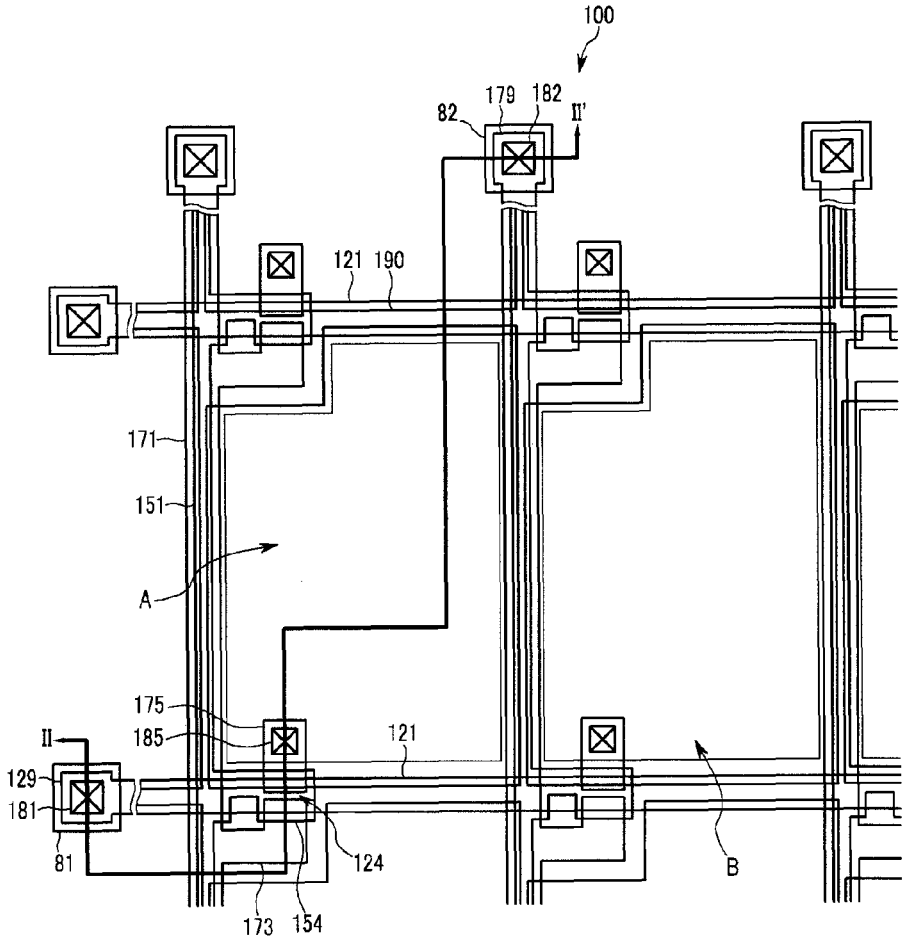
FIG. 1 is a layout view illustrating a structure of an electrophoretic display that may be driven by a method for driving an electrophoretic display according to the present disclosure.

In the drawings, the thickness of layers, films, panels, regions, etc., may be exaggerated for clarity and thus not to scale. Like reference numerals generally designate like elements throughout. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Methods for using electrophoretic displays according to one or more of various exemplary embodiments will be described with reference to the accompanying drawings.

Figure 2:
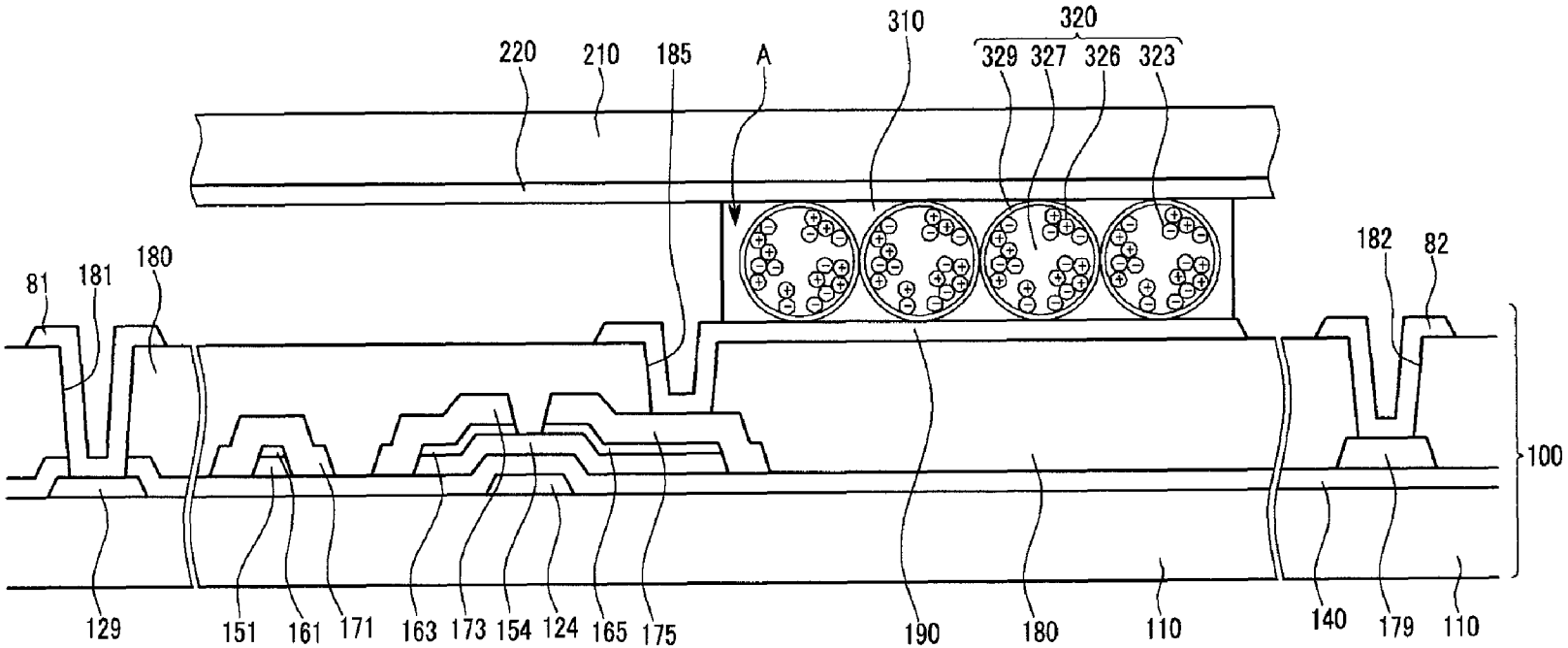
FIG. 2 is a cross-sectional view taken along line II-II' of the electrophoretic display of FIG. 1, FIGS. 3 and 4 are cross-sectional views illustrating four pixel regions including a first pixel region and a second pixel region, respectively, of the electrophoretic display of FIG. 1.
Figure 3:
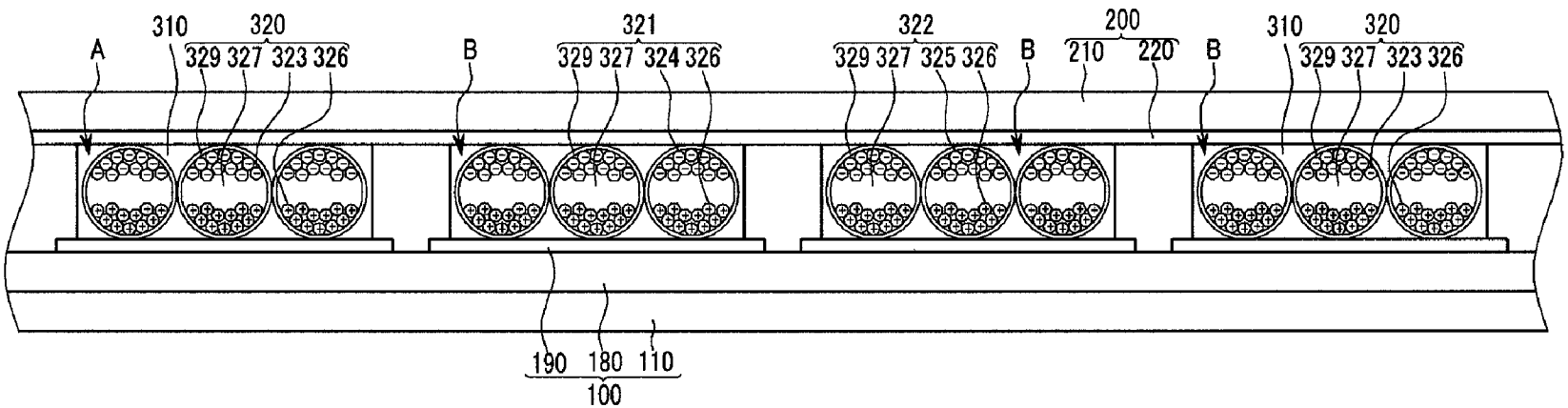

First, a structure of an exemplary electrophoretic display will be described in detail with reference to FIGS. 1 and 4. FIG. 1 is a layout view illustrating a structure of an electrophoretic display that may be driven by one more of the current alternating methods disclosed herein. FIG. 2 is a cross-sectional view taken along line II-II' of the electrophoretic display of FIG. 1, and FIGS. 3 and 4 are cross-sectional views illustrating four pixel regions (pixel areas) including a first pixel region and a second pixel region, respectively, of the electrophoretic display of FIG. 1.

The illustrated electrophoretic display includes a thin film transistor array containing panel 100, a common electrode containing panel 200 facing the thin film transistor array panel 100, and an electrophoretic particles containing member 320 positioned in pixel regions such as A and B, respectively, between the panels 100 and 200.

First, a thin film transistor array containing panel 100 will be described.

Figure 4:
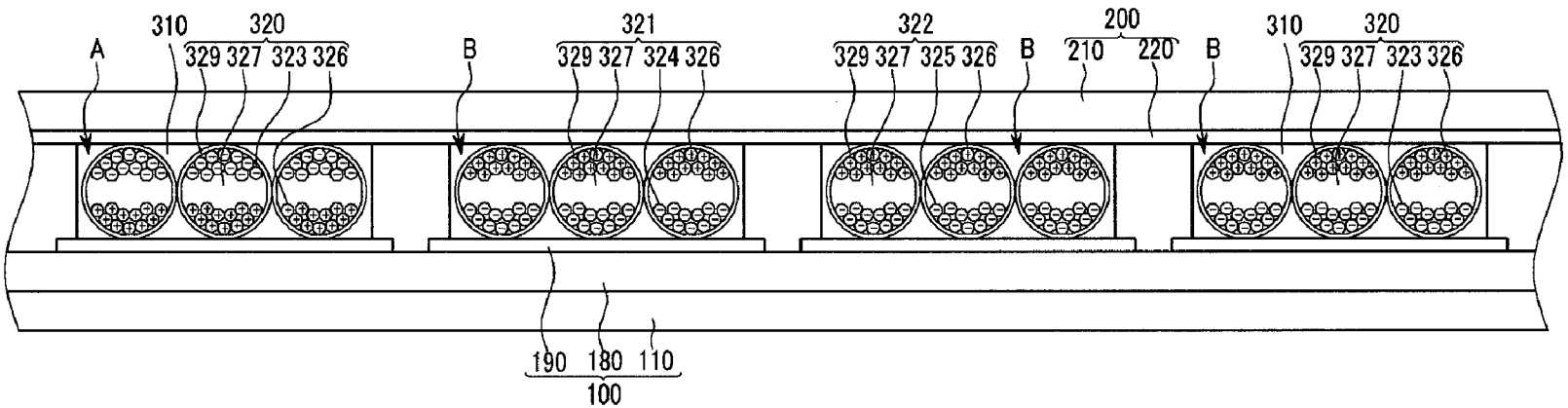

As shown in FIGS. 1 and 4, a plurality of gate lines 121 for transmitting gate signals are formed on an electrically insulative substrate 110 made of transparent glass or another electrically insulative and light passing material. The gate lines 121 extend substantially in a transverse direction to the gate lines, and each gate line 121 includes a plurality of gate electrodes 124 and an extended end portion 129 for contact with another layer or an external device.

The gate lines 121 may be made of aluminum-containing metal such as aluminum and/or aluminum-based alloys, silver-containing metals such as silver and silver-based alloys, copper-containing metals such as copper and copper-based alloys, molybdenum-containing metals such as molybdenum and molybdenum-based alloys, chromium, titanium, tantalum, and so forth. Each gate line 121 may include two conductive films having different physical characteristics, i.e., a lower film (not shown) and an upper film (not shown). The upper film may be made of a low resistivity metal such as an Al-containing metal for reducing signal delay or voltage drop in the gate lines 121. On the other hand, the lower film may be made of an interface material such as Mo, a Mo alloy, and Cr, which has good contact characteristics with other conductive materials such as indium tin oxide (ITO) and indium zinc oxide (IZO). A good example of a combination of the lower film material and the upper film material is Cr and an Al—Nd alloy.

The gate lines 121 may alternatively have a single-layered structure or a triple-layered structure.

A gate insulating layer 140 such as one made of a silicon nitride (SiNx) is formed on the gate lines 121.

A plurality of semiconductor stripes 151 such as those made of hydrogenated amorphous silicon are formed on the gate insulating layer 140. Each semiconductor stripe 151 extends substantially in the longitudinal direction and has a plurality of projections 154 branched out toward the gate electrodes 124. The width of each semiconductor stripe 151 becomes large near the gate lines 121 such that the semiconductor stripe 151 covers large areas of the gate lines 121.

A plurality of ohmic contact lines and islands 161 and 165 such as made of a silicide or n+ hydrogenated a-Si heavily doped with an n-type impurity are formed on the semiconductor stripes 151. Each ohmic contact line 161 has a plurality of projections 163, and the projections 163 and the ohmic contact islands 165 are located in pairs on the projections 154 of the semiconductor stripes 151.

A plurality of data lines 171 and a plurality of drain electrodes 175 are formed on the ohmic contacts 161 and 165 and the gate insulating layer 140, respectively.

The data lines 171 are used for transmitting data voltages. They extend substantially in the longitudinal direction and intersect the gate lines 121. Each data line 171 includes a plurality of source electrodes 173 projecting toward the gate electrodes 124 and curved like a character "J" and an extended end portion 179 having a larger area for contact with another layer or an external device. Each pair of the source electrodes 173 and the drain electrodes 175 are separated from each other and opposite each other with respect to a channel region overlapped by a gate electrode 124.

The data lines 171 and the drain electrodes 175 may be made of a refractory metal such as chromium, a molybdenum-containing metal, tantalum, and titanium, and may have a multi-layered structure including a lower film (not shown) made of Mo, a Mo alloy, or Cr, and an upper film (not shown) located thereon and made of an Al-containing metal.

A gate electrode 124, a source electrode 173, and a drain electrode 175 along with a projection 154 of a semiconductor stripe 151 form a TFT having a channel formed in the projection 154 disposed between the source electrode 173 and the drain electrode 175.

The ohmic contacts 161 and 165 are interposed between the underlying semiconductor stripes 151 and the overlying the source electrode 173 and the overlying drain electrodes 175 thereon, and reduce the contact resistance therebetween.

The semiconductor stripes 151 include a plurality of exposed portions, which are not covered with the data lines 171 and the drain electrodes 175, such as portions located between the source electrodes 173 and the drain electrodes 175. Although the semiconductor stripes 151 are narrower than the data lines 171 at most places, the width of the semiconductor stripes 151 becomes large near the gate lines as described above, to enhance the insulation between the gate lines 121 and the data lines 171.

A passivation layer 180 is formed in a single-layered or multi-layered structure on the data lines 171, the drain electrodes 175, and the exposed portions of the semiconductor stripes 151. The passivation layer 180 may be made of a photosensitive organic material having a good flatness characteristic (planarity), a low dielectric insulating material such as a-Si:C:O and a-Si:O:F formed by plasma enhanced chemical vapor deposition (PECVD), and/or an inorganic material such as a silicon nitride. For example, if the passivation layer 180 is formed of an organic material, to prevent the organic material of the passivation layer 180 from contacting with the semiconductor strips 151 exposed between the data line 171 and the drain electrode 175, the passivation layer 180 can be structured in such a way that an insulating layer (not shown) made of SiNx or $SiO_2$ is additionally formed under the organic material layer.

The passivation layer 180 has a plurality of contact holes 181, 185, and 182 exposing the end portions 129 of the gate lines 121, at least a portion of the drain electrodes 175, and the end portions 179 of the data lines 171, respectively.

A plurality of pixel electrodes 190 and a plurality of contact assistants 81 and 82, which may be made of ITO or IZO, are formed on the passivation layer 180.

The pixel electrodes 190 are physically and electrically connected to the drain electrodes 175 through the contact holes 185 such that the pixel electrodes 190 receive the data voltages from the drain electrodes 175 to apply a data voltage to respective electrophoretic members 320, 321, and 322.

The contact assistants 81/82 are connected to the exposed end portions 129/179 of the gate lines 121/the data lines 171 through the contact holes 181/182. The contact assistants 81 and 82 protect the exposed portions of the gate lines 121 and the data lines 171 and complement the adhesion between the exposed portions and external devices such as a driving integrated circuit.

Next, the common electrode containing panel 200 will be described.

The common electrode panel 200 is opposed to the thin film transistor array containing panel 100, and includes a transparent insulation substrate 210 and a common electrode 220 formed on the insulation substrate 210 and facing the pixel electrodes 190.

The common electrode 220 may be a transparent electrode made of ITO or IZO and it is used to apply a common voltage for thereby creating an electric field interacting with respective electrophoretic particles 323, 324, 325, and 326 of the electrophoretic members 320, 321, and 322.

When the common electrode 220 has a common voltage applied to it, it may change the position of the electrophoretic particles 323, 324, 325, and 326 relative to the respective electrophoretic particles 323, 324, 325, and 326 if a countering driving voltage of sufficient magnitude is applied to the opposed pixel electrodes 190, thereby displaying images of desired black and white luminance or of different colors.

Next, the electrophoretic members 320, 321, and 322 will be described.

Each of the electrophoretic members 320, 321, and 322 is sandwiched between the pixel electrodes 190 and the common electrode 220 by use of a binder 310, and is thus positioned in the pixel regions A and B between the pixel electrodes 190 and the common electrode 220.

Each of the electrophoretic members 320, 321, and 322 may alternately and repetitively be disposed in a plurality of pixel regions A and B different from each other.

The first electrophoretic member 320 includes red electrophoretic particles 323, black electrophoretic particles 326, a dispersion medium 327 having the respective electrophoretic particles 323 and 326 dispersed therein, and a capsule 329 enclosing the elements 323, 326, and 327.

The red electrophoretic particles 323 are electrification particles that show a red color and have negative charges.

The black electrophoretic particles 326 are electrification particles that show a black color and have positive charges.

The red electrophoretic particles 323 and the black electrophoretic particles 326 may have positive charges and negative charges, respectively, contrary to the above.

The second electrophoretic member 321 and the third electrophoretic member 322 are the same as the first electrophoretic member 320, except that they include green electrophoretic particles 324 and blue electrophoretic particles 325, respectively, instead of red electrophoretic particles 323. The green electrophoretic particles 324 are electrification particles that show a green color and have negative charges. The blue electrophoretic particles 325 are electrification particles that show a blue color and have negative charges.

The green electrophoretic particle 324 and black electrophoretic particles 326 of the second electrophoretic member 321 may have positive charges and negative charges, respectively, contrary to the above. The blue electrophoretic particles 325 and black electrophoretic particles 326 of the third electrophoretic member 326 may have positive charges and negative charges, respectively, as above.

Meanwhile, the red electrophoretic particles 323, the green electrophoretic particles 324, and the blue electrophoretic particles 325 may be replaced with electrophoretic particles having a yellow color, electrophoretic particles having a magenta color, and electrophoretic particles having a cyan color.

The red electrophoretic particles 323, the green electrophoretic particles 324, and the blue electrophoretic particles 325 all may be replaced with white electrophoretic particles. In this case, unlike the above, the electrophoretic display can represent a luminance of only black and white without other colors.

The dispersion medium 327 may disperse the respective electrophoretic particles 323, 324, 325, and 326, and have a transparent or black color. If the dispersion medium 327 shows a black color, the black electrophoretic particles 326 contained in the respective electrophoretic particles 320, 321, and 322 may be omitted since the black color can be represented by using the dispersion medium 327 alone.

The capsule 329 encloses the respective electrophoretic particles 323, 324, 325, and 326 and the dispersion medium 327, and accordingly, the respective electrophoretic particles 323, 324, 325, and 326 are movable for color representation only within the capsule 329.

Among the pixel regions A and B, it is assumed here that the first pixel region A is a region that represents a relatively constant image having no change for a relatively long time during the driving process of the electrophoretic display. That is, the first pixel area A is a region that represents a luminance of either black or white or represents one color image.

Among the pixel regions A and B, the second pixel region B is a region that represents an image portion having a relatively high degree of change during the same period in the driving of the electrophoretic display. That is, the second pixel region B is a region that represents a different black and white luminance or a different color image. The above will be described again with reference to FIGS. 3 and 4. In the first pixel region A, there is relatively no change in the position of the red electrophoretic particles 323 and the black electrophoretic particles 326 over a relatively long period of time (e.g., 3 seconds of more). Accordingly, an external light is continuously incident on the red electrophoretic particles 323 positioned on the common electrode 220 and then reflected to a user's eyes, so the first pixel region A appears to the user only as a constant red image area. Meanwhile, if there is no change in position when the positions of the red electrophoretic particles 323 and the black electrophoretic particles 326 are opposite to each other, an external light is continuously incident on the black electrophoretic particles 326 positioned on the common electrode 220 and then absorbed, so the first pixel region A displays only as a relatively constant black image. Meanwhile, in the second pixel region B, the positions of the red electrophoretic particles 323, the green electrophoretic particles 324, the blue electrophoretic particles 325, and the black electrophoretic particles 326 are being interchanged at a relatively fast rate in so far as what the user experiences.

As shown in FIG. 3, the external light is reflected by the green electrophoretic particles 324, the blue electrophoretic particles 325, and the red electrophoretic particles 323 positioned on the common electrode in order of increasing distance from the first pixel region A. Due to this, three second pixel regions B display green, blue, and red images in the order of increasing distance from the first pixel region A. However, in FIG. 4, the external light is absorbed by the black electrophoretic particles positioned on the common electrode 220 due to a change in the position of the electrophoretic particles 323, 324, 325, and 326, so all of the three second pixel regions B display an image changed into black.

Hereinafter, a method for driving an electrophoretic display according to various exemplary embodiments will be described in detail with reference to FIGS. 5 to 10.

Figure 6:
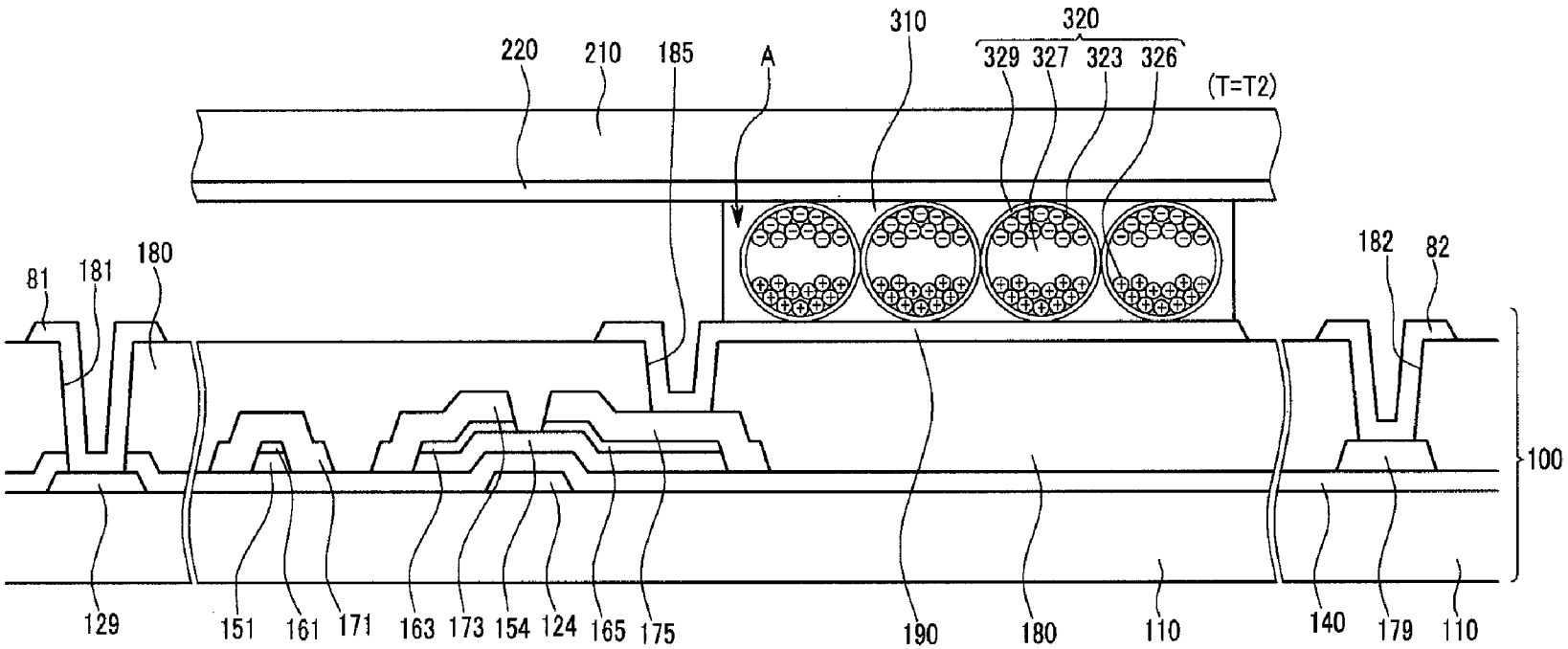
FIGS. 6 and 7 are cross-sectional views of an electrophoretic display showing a different behavior state of the electrophoretic particles positioned in the first pixel region by the application of the driving voltage of FIG. 5.
Figure 7:
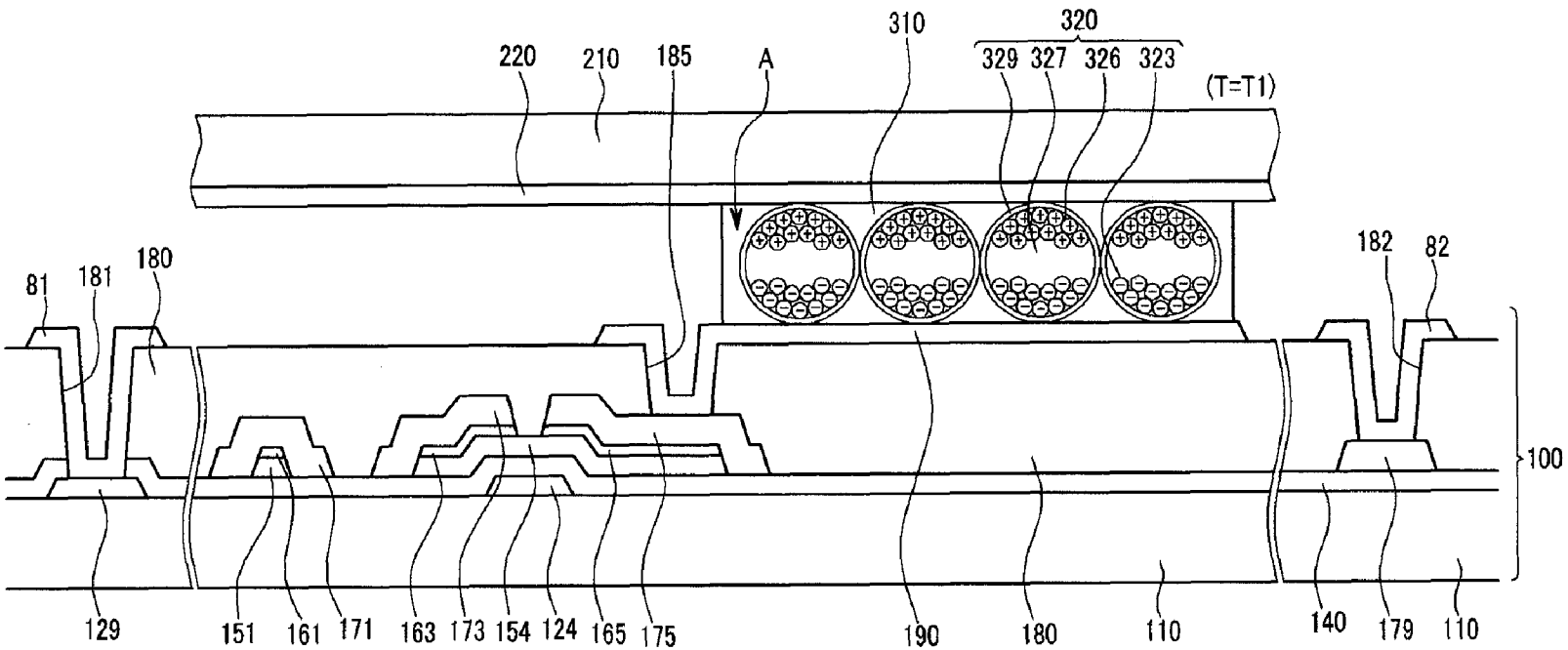
Figure 9:
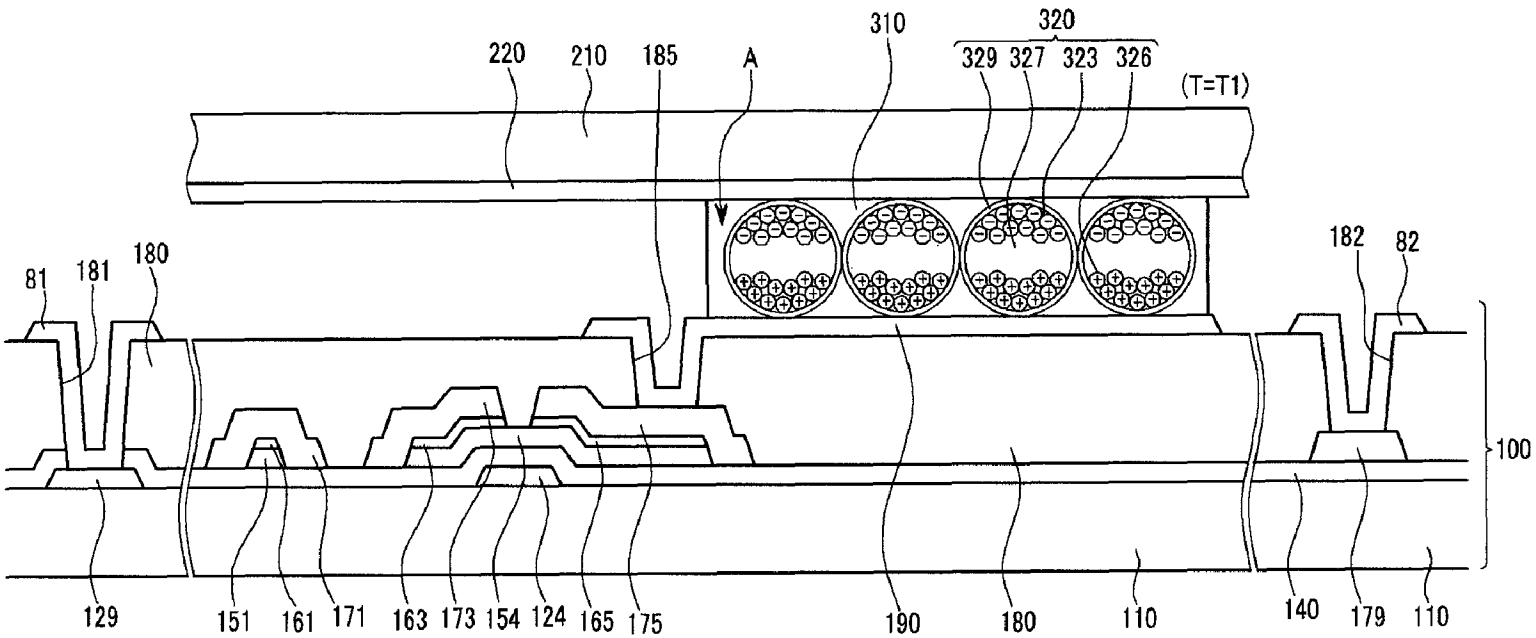
FIG. 9 is a cross-sectional view of an electrophoretic display showing a behavior state of the electrophoretic particles positioned in the first pixel region by the application of the driving voltage of FIG. 8.

FIG. 6, FIG. 7, and FIG. 9 illustrate only a first pixel region A so that the first electrophoretic member 320 including the red electrophoretic particles 323 is positioned therein. However, practically, a plurality of similarly situated first pixel regions A exist, and the second electrophoretic member 321 including the green electrophoretic particles 324 and the third electrophoretic member 322 including the blue electrophoretic particles 325 are positioned in each of the other of first pixel regions A. In addition, each of the electrophoretic members 320, 321, and 322 may be constructed such that they may include white electrophoretic particles instead of the red, green, and blue electrophoretic particles 320, 321, and 322. That is, the first pixel region A may continuously represent any one of green, blue, and white rather than red, green and blue alternating with black.

First, a method for driving an electrophoretic display according to one exemplary embodiment will be described in detail with reference to FIGS. 5 to 7.

Figure 5:
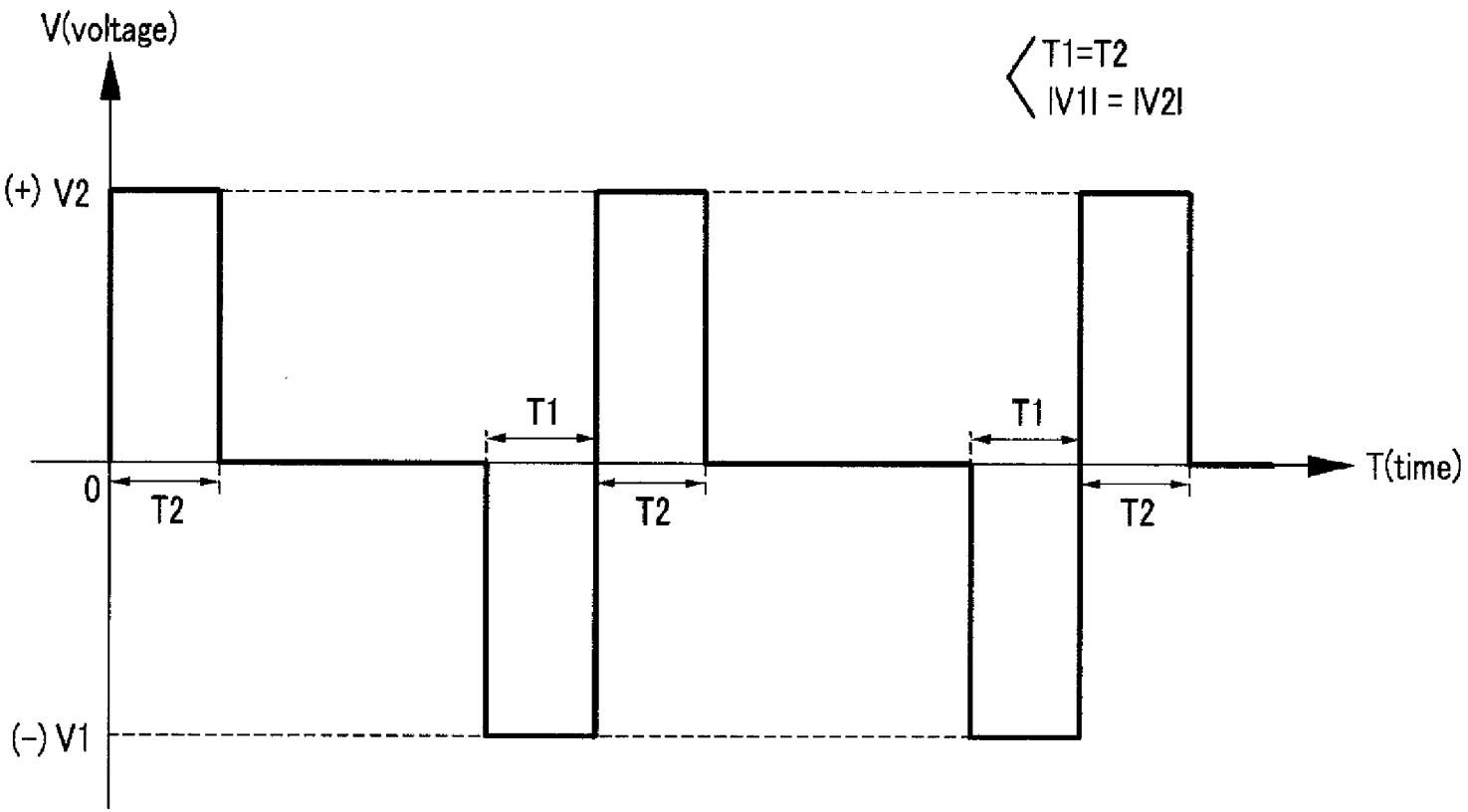
FIG. 5 is a view showing a driving voltage, which is time-dependently applied to electrophoretic particles positioned in the first pixel region for explaining a method for driving an electrophoretic display according to one exemplary embodiment.

FIG. 5 is a view of a voltage versus time graph showing a driving voltage that is time-dependently applied to pixel areas of relatively constant coloration (in so far as what the user sees) so as to thereby position the electrophoretic particles mostly in the desired orientation for providing the apparent coloration that the user sees. FIGS. 6 and 7 are cross-sectional views of the electrophoretic display showing the different behavioral states of the electrophoretic particles positioned in the first pixel region after charge refreshing period T2 and during the current flipping period T1 as provided by the application of the driving voltage of FIG. 5.

In addition, the driving voltage to be mentioned with respect to FIG. 5 means a value obtained by subtracting a data voltage applied to the pixel electrode from a common voltage applied to the common voltage, which is defined as follows.

The first threshold driving voltage (V1) that is applied during first time intervals T1 is a negative (−) voltage of sufficient magnitude to allow the red electrophoretic particles 323 to overcome fluid resistance caused by the dispersion medium 327 and to move the red particles to proximity with the pixel electrodes 190, and to also allow the black electrophoretic particles 326 to overcome the fluid resistance caused by the dispersion medium 327 and to move to proximity with the common electrode 220.

The second threshold driving voltage (V2) that is applied during second time intervals T2 is a positive (+) voltage having substantially the same absolute magnitude as the first threshold driving voltage (V1) and that allows the red electrophoretic particles 323 to overcome fluid resistance caused by the dispersion medium 327 and to move to proximity with the common electrode 220, and it also allows the black electrophoretic particles 326 to overcome fluid resistance caused by the dispersion medium 327 and to move to proximity with the pixel electrode 190.

In the method for driving an electrophoretic display according to one exemplary embodiment, firstly, as shown in FIG. 5, the second threshold driving voltage (V2) is applied for duration of the second time interval T2 to the respective electrophoretic particles 323 and 326 positioned in the first pixel region A of the electrophoretic display.

Here, the second time T2 is at least as large as a minimum time required for the red electrophoretic particles 323 and the black electrophoretic particles 326 to be moved and rearranged in proximity with the common electrode 220 and the pixel electrodes 190, respectively, by the application of the second threshold driving voltage.

Accordingly, as shown in FIG. 2, the red electrophoretic particles 323 that are dispersed in the dispersion medium 327 of the first electrophoretic member 320 positioned in the first pixel region A and have negative charges are moved and arranged in proximity with or on the common electrode 220 as shown in FIG. 6. Meanwhile, the black electrophoretic particles 326 having positive charges are moved toward the pixel electrodes 190 to be arranged in proximity with or thereon.

By this arrangement, an external light incident through the common electrode panel 200 is reflected back to the human user by the respective electrophoretic particles 323, thereby displaying the red color represented by the red electrophoretic particles 323. Between the first application of +V2 and first application of −V1, a drive voltage of about zero is maintained and as a result no motive force is applied to the electrophoretic particles.

The first threshold driving voltage V1 is applied to the electrophoretic particles 323 and 326 positioned in the first pixel region A during a following first time interval T1 at a predetermined time interval after the application of the second threshold driving voltage V2, and then the second threshold driving voltage V2 is applied almost immediately thereafter during the next occurrence of second time interval T2.

The first time interval T1 is at least a minimal time that is required for the red electrophoretic particles 323 and the black electrophoretic particles 326 to be moved and rearranged in proximity with the pixel electrodes 190 and the common electrode 330, respectively, by the application of the first threshold driving voltage V1, and has substantially the same length as the second time T2.

As shown in FIG. 7, the red electrophoretic particles 323 are moved from the common electrode 220 to the pixel electrodes 190 and arranged thereon by the application of the first threshold driving voltage V1 during the first time T1. Meanwhile, the black electrophoretic particles 326 having positive charges are moved from the pixel electrodes 190 to the common electrode 220 and arranged thereon.

By this arrangement, an external light incident through the common electrode panel 200 from the outside is absorbed by the black color electrophoretic particles 326. Accordingly, the first pixel area A reflects a black color towards the user's eyes. However, the first pixel region A is a region that should appear as continuously and constantly displaying a red color to the outside. If the first time T1 for applying the first threshold driving voltage V1 is lengthened beyond a predetermined sub-blink time, a person may recognize the switch over to the black color. However, if the first time T1 is kept below the predetermined sub-blink time, for example to less than 1/25 of a second, the average person will not recognize the brief switch over to the black color in the pixel area driven by the waveform of FIG. 5.

Immediately after the first threshold driving voltage V1 is applied to the electrophoretic particles 323 and 326 during the first time T1, the second threshold driving voltage V2 is applied again during the second time T2.

In one embodiment the application of the second threshold driving voltage V2 is carried out periodically and continuously immediately after completion of the application of the first threshold driving voltage V1 (the color reversing voltage). Since the average person cannot recognize the brief flip over to the black color followed by the longer persistence of the intended red color, the first pixel region A will appear to display only the red color due to application of the second threshold driving voltage V2 during the first time intervals T2, followed by longer application of the zero voltage and then brief application of V1 followed by immediate or almost immediate reapplication of V2.

As shown in FIG. 6, the red electrophoretic particles 323 having negative charges are moved to the common electrode 220 and arranged thereon by the application of the second threshold driving voltage V2 during the second time T2. Meanwhile, the black electrophoretic particles 326 having positive charges are moved to the pixel electrodes 190 and arranged thereon.

By this arrangement, an external light incident through the common electrode panel 200 is reflected by the respective electrophoretic particles 323, thereby displaying the red color represented by the red electrophoretic particles 323.

Afterwards, the first threshold driving voltage V1 and second threshold driving voltage V2 are repeatedly applied to the electrophoretic particles 323 and 326, respectively, during the first time T1 and second time T2, respectively, at a predetermined duty cycle. The duty cycle may be that determined as necessary or sufficient for keeping a capacitance formed by the pixel-electrode and common electrode and the electrophoretic particles interposed therebetween charged to a desired state for retaining the desired orientation of the interposed electrophoretic particles. The duty cycle may be that determined as necessary or sufficient for scanning across the display area and forming a new image frame having some areas thereof retaining a persistent coloration for a substantial length of time (e.g., 3 seconds or greater) while causing other areas to change coloration relatively quickly (e.g., 24, 30 or 60 times every second depending on the vertical frame rate).

After the application of the second threshold driving voltage V2, the red electrophoretic particles 323 are positioned at the common electrode 220 until the first threshold driving voltage V1 is applied again thereto at a predetermined time interval, and positioned in the pixel electrodes 190 of the black electrophoretic particles 326. Accordingly, the first pixel region A continues to represent a red color until the first threshold driving voltage V1 is applied again.

According to another method for driving an electrophoretic display according to one exemplary embodiment, the first pixel area A is driven to persistently display not a red color but a black color in which case, the first threshold driving voltage V1 is applied first during the first time T1 and then reapplied immediately after each strobing with V2.

Accordingly, according to one method for driving an electrophoretic display according to one exemplary embodiment, the first pixel region A is able to represent a relatively constant image. In addition, the first threshold driving voltage V1 and the second threshold driving voltage V2 having the same size and the opposite polarity to each other are alternately applied to the electrophoretic particles 323 and 326, thus the polarity of the data voltage applied to the pixel electrodes 190 positioned in the first pixel region A is reversed. Accordingly, in the thin film transistor and/or other circuitry connected to the pixel electrodes 190, experiences current flows moving alternately not just to one side but in both directions and by equal magnitudes to both sides. Thus the degree of potential deterioration to parts that can suffer deterioration from persistent unidirectional current flow is reduced as compared to the case where current flows a majority of time in only one direction.

Meanwhile, in this embodiment, the second threshold driving voltage V2 that is initially applied before the first threshold driving voltage V1 is firstly applied to the electrophoretic particles 323 and 326, the initial application of the second threshold driving voltage V2 may be omitted, and the first threshold driving voltage V1 and the second threshold driving voltage V2 that are periodically consecutive may be applied.

Hereinafter, a second method for driving an electrophoretic display according to the same or another embodiment will be described with reference to FIGS. 8 and 9.

Figure 8:
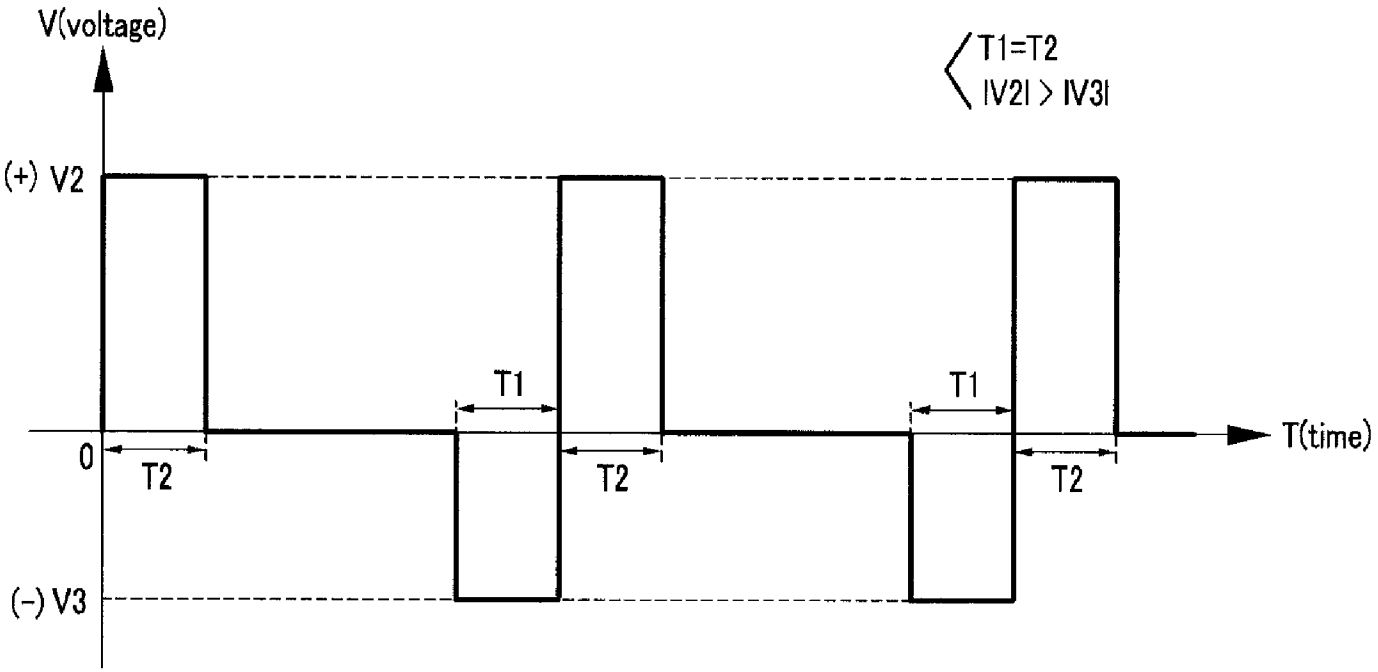
FIG. 8 is a view showing a driving voltage, which is time-dependently applied to electrophoretic particles positioned in the first pixel region for explaining a method for driving an electrophoretic display according to another exemplary embodiment.

FIG. 8 is a voltage versus time graph showing another driving voltage that may be time-dependently applied to pixel areas of electrophoretic particles positioned in the first pixel region A. FIG. 9 is a cross-sectional view of an electrophoretic display showing a behavior state of the electrophoretic particles positioned in the first pixel region A by the application of the driving voltage of FIG. 8.

In addition, the driving voltage to be mentioned with respect to FIG. 8 means a value obtained by subtracting a data voltage applied to the pixel electrode from a common voltage applied to the common voltage, which is defined as follows.

The first threshold driving voltage V3 that is applied during first time intervals T1 is a negative (−) voltage of sufficiently low magnitude that it allows the red electrophoretic particles 323 and black electrophoretic particles included in the dispersion medium 327 to maintain their original spatial state. In other words, V3 is of sufficiently small amplitude that it does not provide enough motive force to the electrophoretic particles to cause them to substantially change in their respective positions during time period T1.

The second threshold driving voltage V2 is a positive (+) voltage of absolute amplitude greater than that of the first threshold driving voltage V3 and the amplitude of V2 is sufficiently large that it does provide enough motive force to the electrophoretic particles to cause the red electrophoretic particles 323 to overcome fluid resistance caused by the dispersion medium 327 and move towards the common electrode 220, and also to cause the black electrophoretic particles 326 to overcome fluid resistance caused by the dispersion medium 327 and move towards the pixel electrode 190 during the time period T2.

The method for driving an electrophoretic display according to this exemplary embodiment is roughly the same as the method for driving an electrophoretic display according to previous exemplary embodiment of the present invention as shown in FIGS. 5 to 7, except that the firstly-applied driving voltage V3 has a magnitude substantially smaller than the secondly-applied driving voltage V2 and has an opposite polarity. Moreover in the second embodiment, the first time T1 interval associated with the firstly-applied driving voltage V3 has substantially the same length as the second time T2 associated with the secondly-applied threshold driving voltage V2 where both V3 and V2 are applied as sequentially adjacent pairs according to a predetermined cycle after the initial application of just the second threshold driving voltage V2.

Because the first threshold driving voltage V3 is a voltage of such a magnitude as to not change the position of the respective electrophoretic particles 323 and 326, the electrophoretic particles 323 and 326 maintain the state as shown in FIG. 9 during the first time T1. Accordingly, the first pixel region A of the electrophoretic display can continuously represent a red image. Given this, the first time T1 does not need to be specifically restricted to a particular length for applying the first threshold driving voltage V3.

Therefore, according to the method for driving an electrophoretic display according to FIGS. 8 and 9, the first pixel region A is able to represent a constant image, and reduce the deterioration of the thin film transistor of the electrophoretic display as compared to a situation where the circuitry associated with a pixel area having persistent coloration is persistently subjected to current flows in only one direction.

Hereinafter, a third method for driving an electrophoretic display will be described with reference to FIG. 10.

Figure 10:
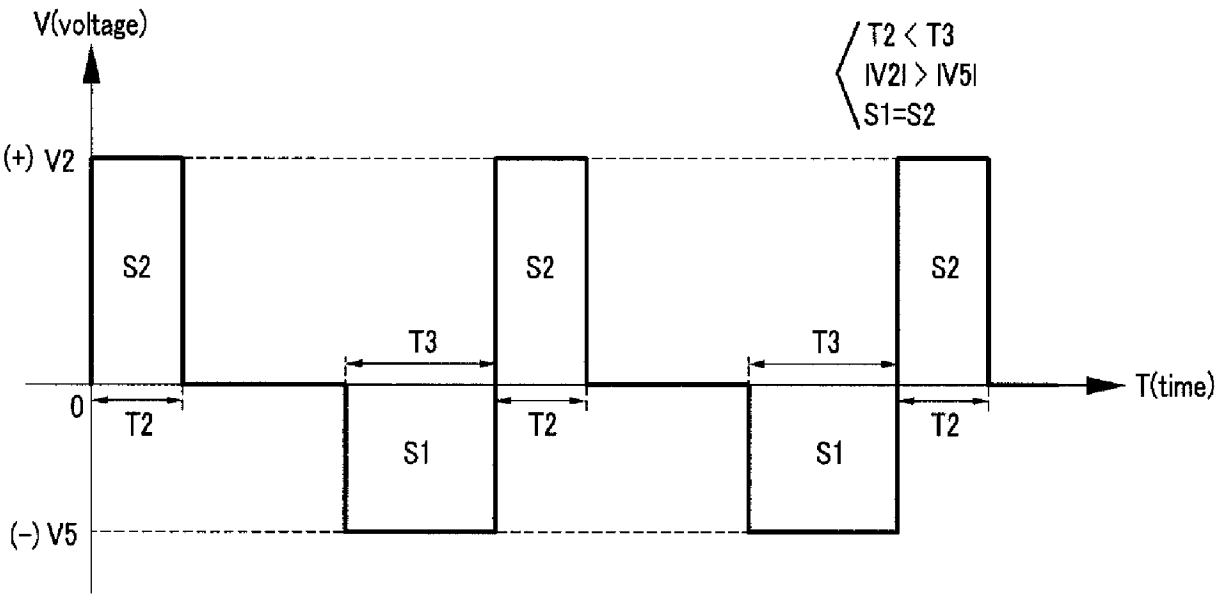
FIG. 10 is a view showing a driving voltage, which is time-dependently applied to electrophoretic particles positioned in the first pixel region for explaining a method for driving an electrophoretic display according to another exemplary embodiment.

FIG. 10 is a view showing a driving voltage that is time-dependently applied to electrophoretic particles positioned in the first pixel region for explaining a method for driving an electrophoretic display according to another exemplary embodiment of the present disclosure.

In addition, the driving voltage to be mentioned with respect to FIG. 10 means a value obtained by subtracting a data voltage applied to the pixel electrode from a common voltage applied to the common voltage, which is defined as follows.

The first threshold driving voltage V5 is a negative (−) voltage of sufficiently low magnitude that it allows the red electrophoretic particles 323 and black electrophoretic particles included in the dispersion medium 327 to maintain their original spatial state, in other words, without causing a change in their respective positions.

The second threshold driving voltage V2 is a positive (+) voltage having an absolute amplitude greater than that of the first threshold driving voltage V5 and V2 is of sufficiently large magnitude that it allows the red electrophoretic particles 323 to overcome fluid resistance caused by the dispersion medium 327 and to move towards the common electrode 220, and it allows the black electrophoretic particles 326 to overcome fluid resistance caused by the dispersion medium 327 and to move towards the pixel electrode 190.

The method for driving an electrophoretic display according to this exemplary embodiment is roughly similar to the method for driving an electrophoretic display according to FIGS. 8 to 9, except that the first threshold driving voltage V3 has an absolute magnitude substantially smaller than that of the second threshold driving voltage V2 and V3 has an opposite polarity and V3 is applied to the respective electrophoretic particles 323 and 326 during the first time T3 that is substantially longer than the second time T2, where the V3 pulse is applied just before the second threshold driving voltage V2 is applied again thereto during the second time T2 in a predetermined duty cycle after the initial application of the second threshold driving voltage V2.

The first time T3 that is longer than the second time T2 may be set in a manner such that a value S1 of multiplication of the first time T3 and the first threshold driving voltage V5 may be substantially equal to a value S2 of multiplication of the second time T2 and the second threshold driving voltage V2. Such balancing in the voltage versus time plots of the areas under the positive driving voltages with the areas under the negative driving voltages helps to balance the amount of charge that is driven through the circuitry in the respective positive and negative directions. As such, deterioration of the thin film transistors can be further reduced because it is possible to perform reverse driving of the electrophoretic display in a balanced manner similar to the method for driving an electrophoretic display according to the exemplary embodiment shown in FIGS. 5 to 7.

Therefore, according to the method for driving an electrophoretic display according to FIG. 10, the first pixel region A is able to represent a constant image, and at the same time reduce the deterioration of the thin film transistor of the electrophoretic display that may be due to persistent driving of current therethrough in only one direction.

The above exemplary embodiments have described a number of driving methods for allowing the first pixel region A to appear to be continuously of a red color. However, it is needless to say that the first pixel region A can be similarly driven to instead continuously appear to represent a black color by applying a driving voltage waveform, which has the opposite polarity to the first and second threshold driving voltages mentioned in the above exemplary embodiments and having the same magnitude thereof, to the electrophoretic particles 323 and 326.

While examples have been described in connection with what is presently considered to be practical in the current art, it is to be understood that the disclosure is not to be considered as limited to just the disclosed embodiments regarding electrophoretic particles, but, on the contrary, it is intended to cover various modifications and equivalent arrangements included within the spirit and scope of the disclosure including application to other situations where it is advantageous to drive balanced positive and negative going currents through circuitry of similar types of displays while causing the viewing person to perceive certain areas as having a relatively persistent coloration and/or luminosity.

What is claimed is:

1. A method for causing one or more areas of a display that is driven by electromotive signals to appear to respectively have relatively persistent optical states wherein persistent driving with unidirectional electromotive signals of circuitry associated with the one or more areas of the display tends to increase deterioration of said circuitry, the method comprising:

periodically driving a pixel unit in one of said persistent areas of the display with a first driving signal of a first polarity that drives the pixel unit to providing its relatively persistent optical state; and before one or more of the periodic drivings with the first driving signal, driving the pixel unit with a second driving signal of a second polarity opposite to the first polarity where the second driving signal provides an electromotive force opposite in direction to an electromotive force provided by the first driving signal.

2. The method of claim 1 wherein said pixel unit includes electrophoretic particles.

3. The method of claim 1 wherein:

said periodic driving of the pixel unit with the first driving signal includes applying a first voltage pulse of a predefined first magnitude and a first duration, and said driving of the pixel unit with the second driving signal includes applying a second voltage pulse of a predefined second magnitude and a second duration.

4. The method of claim 3 wherein:

said second duration is substantially equal to the first duration.

5. The method of claim 3 wherein:

said second magnitude has an absolute value substantially equal to the absolute value of said first magnitude.

6. The method of claim 3 wherein:

said second magnitude has an absolute value substantially less than the absolute value of said first magnitude such that the second magnitude is insufficient to drive the pixel unit out of the relatively persistent optical state.

7. The method of claim 6 wherein:

said second duration is longer than said first duration.

8. A method for driving an electrophoretic display, the electrophoretic display including a plurality of thin film transistors formed on an insulation substrate, a pixel electrode connected to the thin film transistor, a common electrode opposed to the pixel electrode, and an electrophoretic member positioned in a pixel region between the pixel electrode and the common electrode and including electrophoretic particles, wherein the method comprises:

applying a first threshold driving voltage to the electrophoretic particles of a given pixel unit; and applying a second threshold driving voltage having the opposite polarity of the first threshold driving voltage to the electrophoretic particles of the given pixel unit after the applying of the first threshold driving voltage where the second threshold driving voltage drives the given pixel unit into a desired and relatively persistent optical state.

9. The method of claim 8, further comprising applying the first threshold driving voltage to the electrophoretic particles at a predetermined time interval after the applying of the second threshold driving voltage.

10. The method of claim 8, wherein the applying of the first threshold driving voltage and the applying of the second threshold driving voltage are continuously performed.

11. The method of claim 8, wherein the first threshold driving voltage and the second threshold driving voltage are repetitively applied at a predetermined cycle, respectively.

12. The method of claim 8, wherein the magnitude of the first threshold driving voltage is substantially the same as the magnitude of the second threshold driving voltage.

13. The method of claim 8, wherein the first threshold driving voltage is applied for a first time in the applying of the first threshold driving voltage, and the second threshold driving voltage is applied for a second time in the applying of the second threshold driving voltage.

14. The method of claim 13 wherein the first time is less than 1/25 of a second.

15. The method of claim 13, wherein the first time is substantially equal to the second time.

16. The method of claim 8, wherein the magnitude of the first threshold driving voltage is smaller than the magnitude of the second threshold driving voltage.

17. The method of claim 16, wherein the first threshold driving voltage is of such a magnitude that a position of the electrophoretic particles is not changed.

18. The method of claim 16, wherein the first time is substantially equal to the second time.

19. The method of claim 16, wherein the first time is longer than the second time.

20. The method of claim 19, wherein a result of the multiplication of the first threshold driving voltage and the first time is substantially equal to a result of the multiplication of the second threshold driving voltage and the second time.

21. The method of claim 8, wherein the electrophoretic member further comprises a dispersion medium having the electrophoretic particles dispersed therein.

22. The method of claim 21, wherein the electrophoretic member further comprises a capsule enclosing the electrophoretic particles and the dispersion medium.

23. The method of claim 8, wherein the electrophoretic particles further comprise first electrophoretic particles and second electrophoretic particles whose polarities are opposite to each other.

24. A circuit for causing one or more areas of a display that is driven by electromotive signals to appear to respectively have relatively persistent optical states wherein persistent driving with unidirectional electromotive signals of circuitry associated with the one or more areas of the display tends to increase deterioration of said circuitry, the circuit comprising:

first means for periodically driving a pixel unit in one of said persistent areas of the display with a first driving signal of a first polarity that drives the pixel unit to providing its relatively persistent optical state; and second means that operates before one or more of the periodic drivings with the first driving signal, for briefly driving the pixel unit with a second driving signal of a second polarity opposite to the first polarity where second driving signal drives the pixel unit away from the persistent optical state and where the second driving signal provides an electromotive force opposite in direction to an electromotive force provided by the first driving signal.

* * * * *